US007193601B2

(12) United States Patent
Furuya

(10) Patent No.: US 7,193,601 B2
(45) Date of Patent: Mar. 20, 2007

(54) ACTIVE MATRIX LIQUID CRYSTAL DISPLAY

(75) Inventor: Masato Furuya, Yokosuka (JP)

(73) Assignee: Victor Company of Japan, Limited, Kanagawa-ken (JP)

( * ) Notice: Subject to any disclaimer, the term of this patent is extended or adjusted under 35 U.S.C. 154(b) by 361 days.

(21) Appl. No.: 10/623,571

(22) Filed: Jul. 22, 2003

(65) Prior Publication Data

US 2004/0104881 A1 Jun. 3, 2004

(30) Foreign Application Priority Data

Jul. 24, 2002 (JP) ..... P2002-215736

(51) Int. Cl.
*G09G 3/36* (2006.01)

(52) U.S. Cl. ..... 345/100; 345/51; 345/53; 345/99

(58) Field of Classification Search ..... 345/100, 345/51, 53, 99, 50, 87, 98
See application file for complete search history.

(56) References Cited

U.S. PATENT DOCUMENTS

| | | | | |
|---|---|---|---|---|
| 5,132,678 | A * | 7/1992 | Morris | 345/559 |
| 5,179,371 | A * | 1/1993 | Yamazaki | 345/93 |
| 5,818,526 | A * | 10/1998 | Nomoto | 348/302 |
| 7,042,426 | B2 * | 5/2006 | Shin | 345/76 |
| 2002/0011994 | A1 * | 1/2002 | Imamura | 345/204 |
| 2002/0158831 | A1 * | 10/2002 | Kondoh | 345/97 |
| 2003/0016202 | A1 * | 1/2003 | Edwards et al. | 345/98 |
| 2003/0025815 | A1 * | 2/2003 | Hashimoto | 348/296 |

FOREIGN PATENT DOCUMENTS

| | | |
|---|---|---|
| JP | 05-006151 | 1/1993 |
| JP | 06-202076 | 7/1994 |
| JP | 08-221039 | 8/1996 |
| JP | 10-083169 | 3/1998 |
| JP | 2000-214828 | 8/2000 |
| JP | 2001-134245 | 5/2001 |
| JP | 2001-331156 | 11/2001 |
| JP | 2002-323876 | 11/2002 |

* cited by examiner

*Primary Examiner*—Amr A. Awad
*Assistant Examiner*—Seokyun Moon
(74) *Attorney, Agent, or Firm*—The Nath Law Group; Jerald L. Meyer; Stanley N. Protigal

(57) ABSTRACT

An active matrix LCD defines a display signal period and a reset period in each vertical scan period. The display signal period is a period to write and hold display signals in pixels in response to a row select pulse generated from an output pulse of a first shift register (SR1). The reset period is a period to write and hold a reset voltage in the pixels in response to a row select pulse generated from an output pulse of a second shift register (SR2). The ratio of the display signal period to the reset period is adjustable in units of horizontal scan time by changing the number "n" of horizontal scan periods to be passed between the time when the first shift register receives a scan start signal (WT) and the time when the second shift register receives a scan start signal (Reset).

3 Claims, 8 Drawing Sheets

FIG.8A
FIG.8B
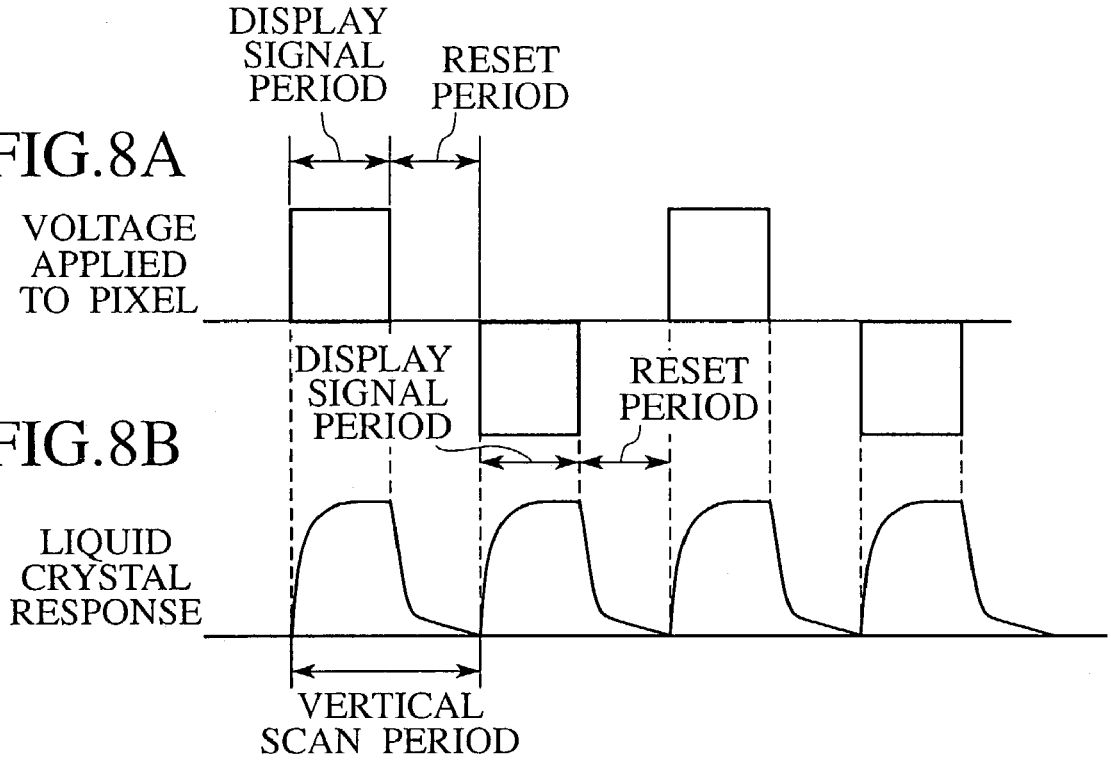
FIG.9A
FIG.9B
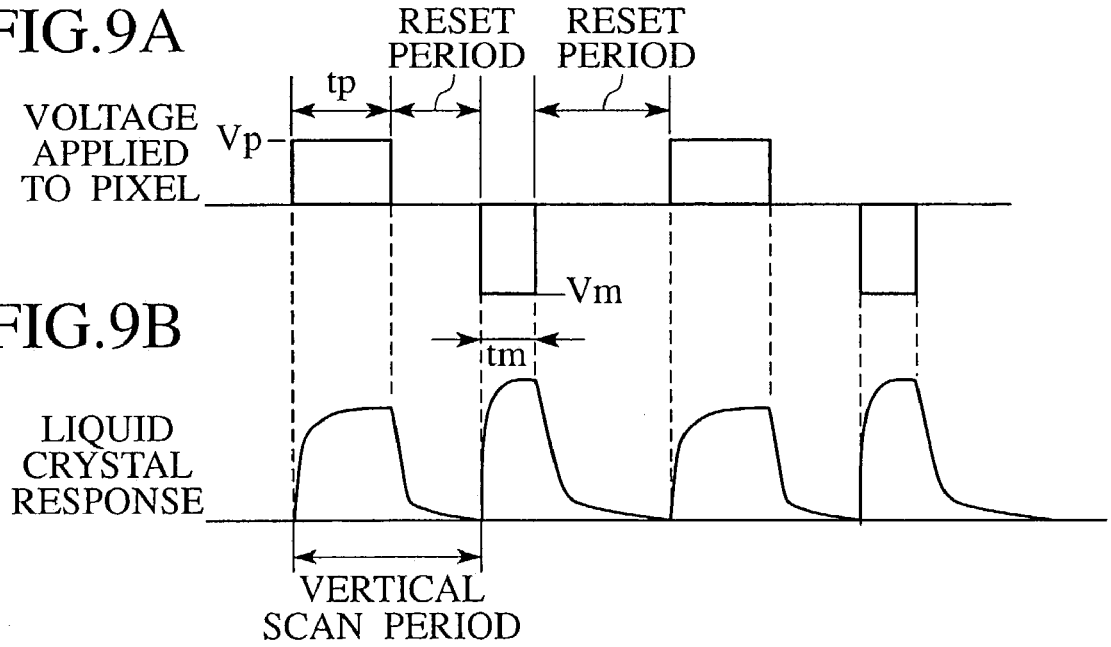
tp,tm : DISPLAY SIGNAL PERIOD

ACTIVE MATRIX LIQUID CRYSTAL DISPLAY

BACKGROUND OF THE INVENTION

1. Field of the Invention

The present invention relates to an active matrix liquid crystal display, and particularly, to that suitable for a projection liquid crystal display.

2. Description of Related Art

FIG. 1 is a schematic view showing an example of an active matrix, LCD (liquid crystal display) according to a related art. The LCD has column electrodes D1 took for display signals and row electrodes G1 to Gm for scanning. The row scan-electrodes G1 to Gm are orthogonal to the column signal-electrodes D1 to Dk. At each intersection of the column signal-electrodes and row scan-electrodes, a pixel PIX is formed. The pixels PIX are arranged in a two-dimensional matrix.

The column signal-electrodes D1 to Dk are driven by a column signal-electrode driver 1 having a horizontal shift register 2 and a group of switches SW. The shift register 2 has output stages connected to control terminals of the switches SW, respectively. Input terminals of the switches SW are commonly connected to a display signal (SIG) input terminal. Output terminals of the switches SW are connected to the column signal-electrodes D1 to Dk, respectively. The related art of FIG. 1 has k column signal-electrodes D1 to Dk, and therefore, there are k switches SW and the shift register 2 has k output stages.

The shift register 2 receives a horizontal start signal HST and a horizontal clock signal HCK from a timing signal generator (not shown). The output stages of the shift register 2 sequentially provide ON pulses to the control terminals of the switches SW, to sequentially turn on the switches SW and sequentially apply display signals SIG through the display signal input terminal to the column signal-electrodes D1 to Dk.

The row scan-electrodes G1 to Gm are driven by a row scan-electrode driver 3 having a shift register. The shift register has output stages connected to the row scan-electrodes G1 to Gm, respectively. The shift register receives a vertical start signal VST and a vertical clock signal VCK from a timing signal generator (not shown) and sequentially applies row select pulses to the row scan-electrodes G1 to Gm.

FIG. 2 shows one of the pixels PIX formed at the intersections of the column signal-electrodes D1 to Dk and row scan-electrodes G1 to Gm. The pixel PIX consists of a switching transistor Tr, a supplementary capacitor Cs, a display electrode (not shown), and a liquid crystal module (LCM). When a row select pulse is supplied to a row scan-electrode G connected to the pixel PIX, the switching transistor Tr of the pixel PIX as well as the switching transistors of the other pixels connected to the same row scan-electrode G turn on to receive display signals through the column signal-electrodes D1 to Dk. In the pixel PIX shown in FIG. 2, the display signal supplied a column signal-electrode D is stored in the capacitor Cs through the transistor Tr, and at the same time, drives the LCM. The capacitor Cs holds a liquid crystal drive voltage for an OFF period of the transistor Tr, to drive the LCM at high duty.

According to the related art, each pixel PIX has the switching transistor Tr and the supplementary capacitor CS to hold a display signal voltage. Namely, the related art employs a hold-type display method that holds a signal voltage representative of display information for nearly a whole frame. This method fundamentally has the following problems:

(1) Inferior Dynamic Image Resolution Due to Human Vision

The human vision works like a time-response filter that causes a delay when responding to a stimulus. A video device reproduces moving images by speedily displaying many frames of still images that are slightly different from one another. These still images produce after images on the human vision, and therefore, the human vision senses that the object is moving. The active matrix LCD employing the hold-type display method continuously displays a first frames image up to a moment to display a second frame image. As a result, the human vision sees an afterimage of the first frame image over the second frame image. This results in blurring the second frame image and deteriorating dynamic image resolution.

(2) Applied Voltage and Liquid Crystal Response

Response of liquid crystals is dependent on the cell gap, viscosity, elastic constant, and other characteristics of the liquid crystals. In particular, the response of liquid crystals delays in a halftone region where a voltage applied to the liquid crystals is above a threshold voltage. Such a delay in the response of liquid crystals deteriorates dynamic image resolution.

SUMMARY OF THE INVENTION

An object of the present invention is to provide an active matrix LCD that writes display signals in each row of pixels of the LCD in a first part of a frame period (vertical scan period) and resets each row of the pixels to a reset voltage in a second part of the frame period, to thereby secure dynamic image resolution.

Another object of the present invention is to provide an active matrix LCD employing a simple structure to optionally set a display signal period and a reset period in each frame period, to satisfy different system requirements and realize different display modes such as a "brightness priority" mode and a "dynamic image characteristic priority" mode.

In order to accomplish the objects, a first aspect of the present invention provides an active matrix LCD having column electrodes for display signals and row electrodes for scanning, the row electrodes being orthogonal to the column electrodes, a column driver to sequentially supply display signals to the column electrodes, a row driver to sequentially supply row select pulses to the row electrodes, and pixels arranged in a matrix at intersections of the column and row electrodes, respectively. The column driver sequentially supplies, in each horizontal scan period, display signals to the column electrodes so that the display signals are written in a row of the pixels the row driver has selected for the horizontal scan period.

The active matrix LCD also has a controller configured to optionally set the ratio of a display signal period to a reset period, the display and reset periods being defined in each vertical scan period (frame period), the display signal period being a period to write and hold display signals in those of the pixels contained in a selected row, the reset period being a period to write and hold a reset voltage in the pixels in the selected row.

The first aspect writes display signals in the pixels row by row in a frame period and resets the pixels row by row to the reset voltage in the same frame period. The first aspect can optionally set the ratio of the display signal period to the reset period in each frame period.

A second aspect of the present invention forms the controller of the first aspect with a level setter configured to partly or wholly set a horizontal blanking period of the horizontal scan period as a period to provide the reset voltage, an output unit configured to turn on all switches of the column driver in the reset period during which display signals have no image information, and in cooperation with the level setter, supply the reset voltage to all of the column electrodes, and a row selector configured to sequentially provide, in cooperation with the row driver, row select pulses to select the row electrodes one after another for each horizontal scan period including a first period during which the row driver provides the column electrodes with the display signals having image information and a second period during which the output unit provides the column electrodes with the reset voltage such that an absolute value of voltage accumulated in each pixel due to the display signal is below a predetermined value in each vertical scan period.

The nature, principle and utility of the invention will become more apparent from the following detailed description when read in conjunction with the accompanying drawings.

BRIEF DESCRIPTION OF THE DRAWINGS

In the accompanying drawings:

FIGS. 8A and 8B are model views showing an example of a voltage applied to a pixel and a liquid crystal response of the pixel in an active matrix LCD according to an embodiment of the present invention; and FIGS. 9A and 9B are model views showing another example of a voltage applied to a pixel and a liquid crystal response of the pixel in an active matrix LCD according to an embodiment of the present invention.

DETAILED DESCRIPTION OF EMBODIMENTS

Figure 1:
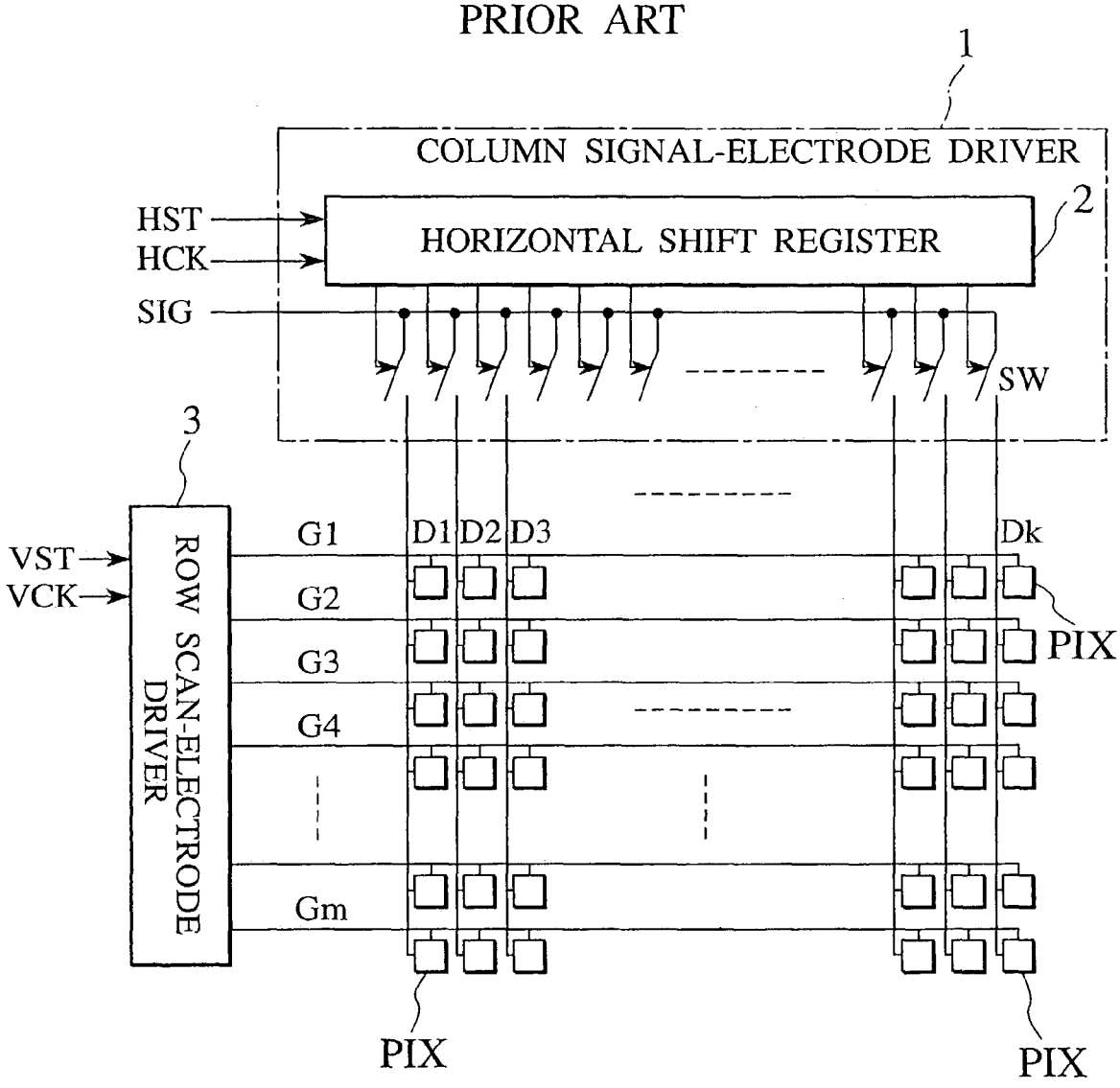
FIG.1 PRIOR ART
FIG. 1 is a schematic view showing an example of an active matrix LCD according to a related art.
Figure 2:
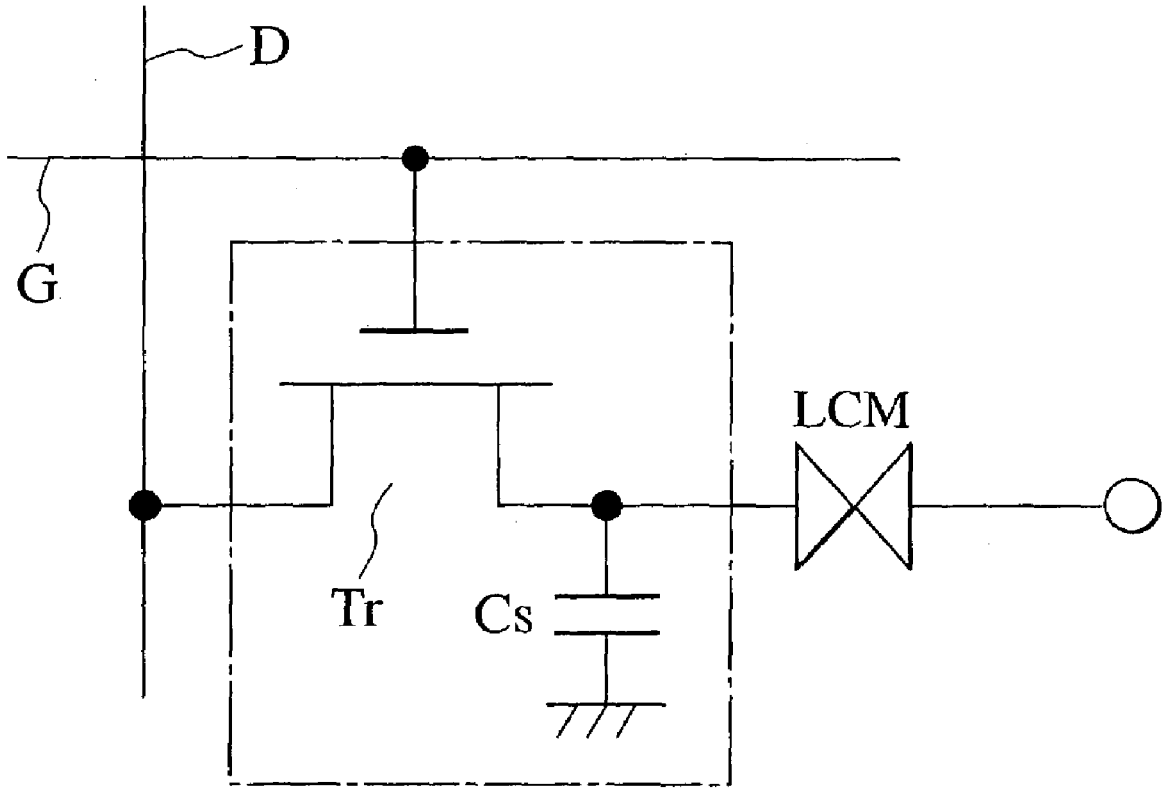
FIG.2 PRIOR ART
FIG. 2 is a circuit diagram showing a pixel in the LCD of FIG. 1.
Figure 3:
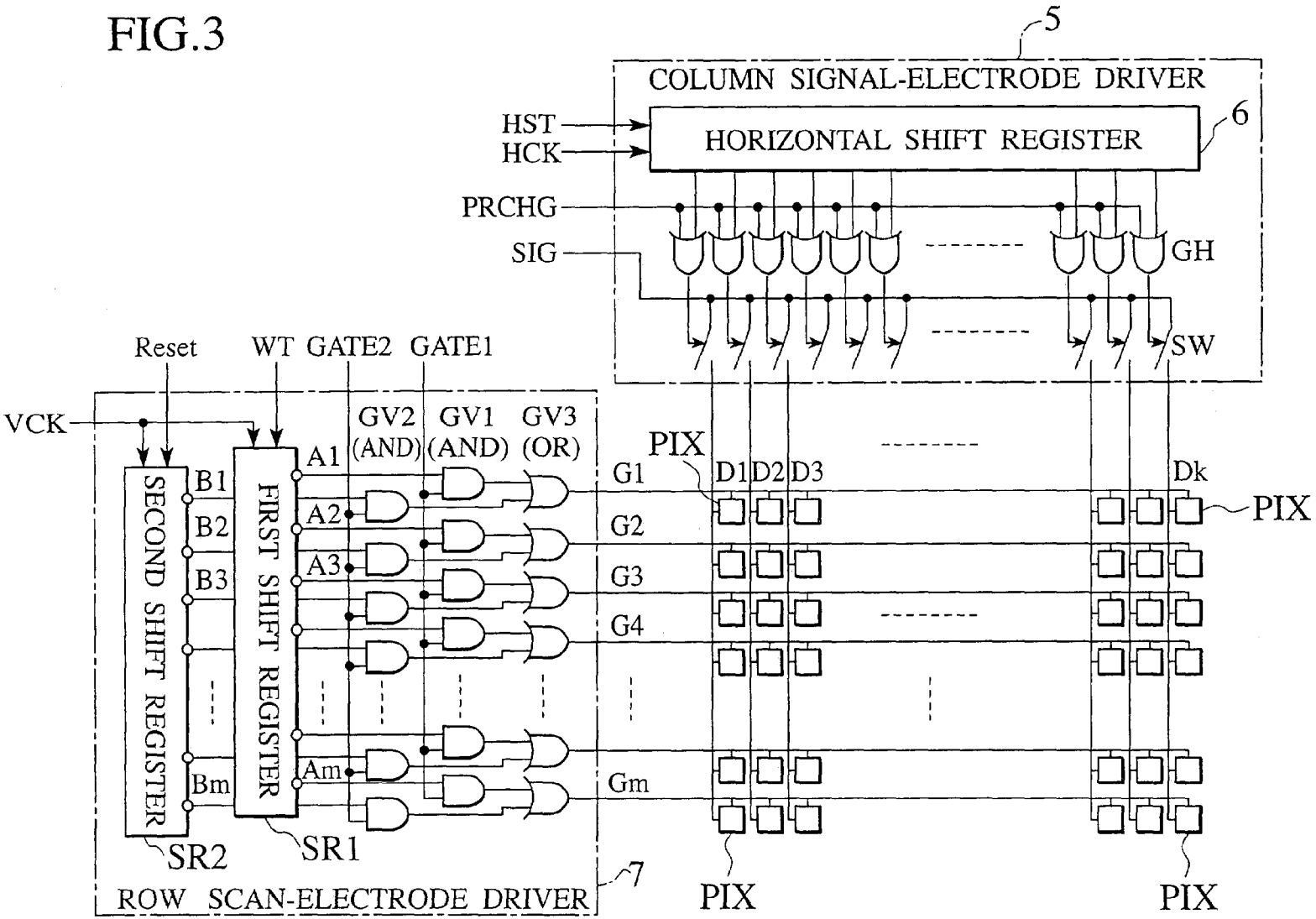
FIG. 3 is a circuit diagram showing an active matrix LCD according to an embodiment of the present invention.

Embodiments of the present invention will be explained with reference to the accompanying drawings. FIG. 3 is a circuit diagram showing an active matrix LCD according to an embodiment of the present invention. The LCD includes column signal-electrodes D1 to Dk and row scan-electrodes G1 to Gm that are orthogonal to the column signal-electrodes D1 to Dk. At each intersection of the column signal-electrodes and row scan-electrodes, a pixel PIX is formed. The pixels PIX are arranged in a two-dimensional matrix.

The column signal-electrodes D1 to Dk are driven by a column signal-electrode driver 5. The column signal-electrode driver 5 has a horizontal shift register 6, a switch group SW, and a gate group GH. The gate group GH consists of k two-input OR gates. The horizontal shift register 6 has k bit-output terminals that are connected to first input terminals of the two-input OR gates, respectively. Second input terminals of the two-input OR gates are commonly connected to a gate signal (PRCHG) input terminal. Output terminals of the two-input OR gates are connected to control terminals of switches in the switch group SW, respectively.

The switch group SW consists of k switches whose input terminals are commonly connected to a display signal SIG. Output terminals of the switches are connected to the column signal-electrodes D1 to Dk, respectively.

The horizontal shift register 6 receives a horizontal start signal HST and a horizontal clock signal HCK from a timing signal generator (not shown). In response to the signals HST and HCK, the output terminals of the shift register 6 sequentially supply pulses to the first input terminals of the two-input OR gates.

Receiving the pulses from the shift register 6, the two-input OR gates in the gate group GH sequentially supply pulses to the control terminals of the switches in the switch group SW, to sequentially turn on the switches. As a result, the display signal SIG is passed through the ON switch in the switch group SW to a corresponding column electrode D.

The row scan-electrodes G1 to Gm are driven by a row scan-electrode driver 7. The row scan-electrode driver 7 has two shift registers SR1 and SR2 and gate groups GV1, GV2, and GV3. The first shift register SR1 has bit-output terminals A1 to Am that are connected to first input terminals of two-input AND gates of the first gate group GV1; respectively. The first gate group GV1 consists of m two-input AND gates. Second input terminals of the two-input AND gates of the first gate group GV1 are commonly connected to a first gate signal GATE1.

The second shift register SR2 has bit-output terminals B1 to Bm that are connected to first input terminals of two-input AND gates of the second gate group GV2, respectively. The second gate group GV2 has m two-input AND gates. Second input terminals of the two-input AND gates of the second gate group GV2 are commonly connected to a second gate signal GATE2. Output terminals of the AND gates of the first gate group GV1 are connected to first input terminals of two-input OR gates of the third gate group GV3, respectively. Output terminals of the AND gates of the second gate group GV2 are connected to second input terminals of the two-input OR gates of the third gate group GV3, respectively. The third gate group GV3 consists of m two-input OR gates. Output terminals of the m OR gates of the third gate group GV3 are connected to the row scan-electrodes G1 to Gm, respectively.

Figure 4:
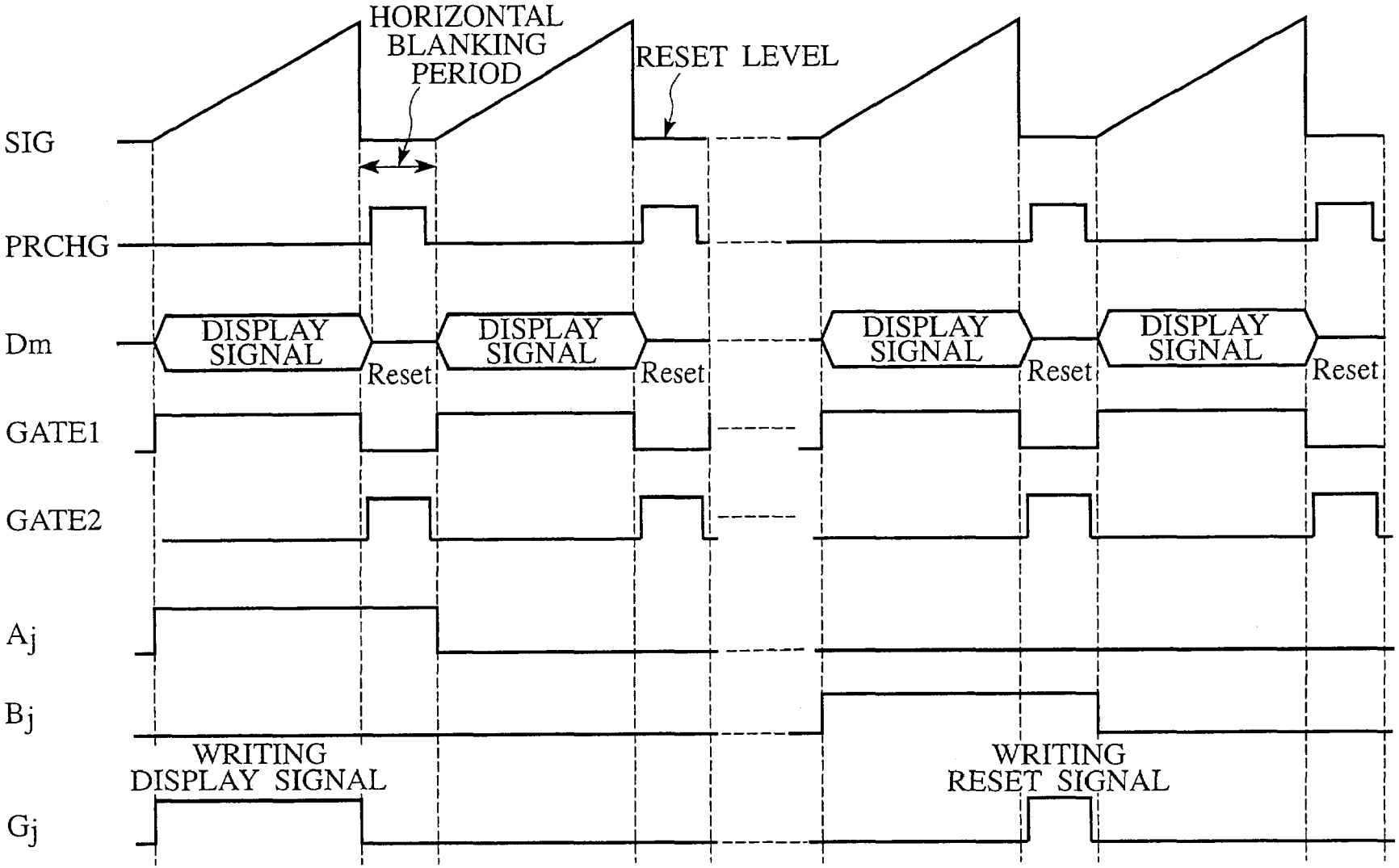
FIG. 4 is a model view showing display and timing signals appearing in successive horizontal scan periods according to the embodiment of FIG. 3.

The drive timing and operation of the active matrix LCD of FIG. 3 will be explained with reference to FIGS. 4 and 5. FIG. 4 shows display and timing signals appearing in successive horizontal scan periods according to the embodiment of FIG. 3.

In FIG. 4, the display signal SIG in a horizontal scan period consists of a display signal period and a horizontal blanking period involving no image information. In part or whole of the horizontal blanking period, a reset voltage is applied. The gate signal PRCHG of FIG. 3 applied to the OR gates of the gate group GH is timed to become high for the reset period defined in the horizontal blanking period. The reset period is a period to apply the reset voltage to the pixels.

In the reset period defined in the horizontal blanking period, the output terminals of all gates in the column signal-electrode driver 5 become high to simultaneously turn on the switches of the switch group SW, thereby simultaneously applying the reset voltage to the column signal-electrodes D1 to Dk.

In the row scan-electrode driver 7, the first and second shift registers SR1 and SR2 are connected to the first and second gate groups GV1 and GV2, respectively. The gate groups GV1 and GV2 are composed of AND gates and receive the signals GATE1 and GATE2, respectively, at the timing shown in FIG. 4. The signal GATE1 is set to fall before the gate signal PRCHG makes the column signal-electrode driver 6 apply the reset voltage to the column signal-electrodes D1 to Dk. The signal GATE2 is set to fall after the gate signal PRCHG makes the column signal-electrode driver 6 apply the reset voltage to the column signal-electrodes D1 to Dk.

In the first shift register SR1, a "j"th output terminal Aj (j being a natural number satisfying $1 \leqq j \leqq m$) may provide an output pulse having a logic level of high. This output pulse is received by a "j"th AND gate in the first gate group GV1 and is ANDed therein with the gate signal GATE8. Then, the output of this "j"th AND gate is supplied to the corresponding row electrode Gj through the gate group GV3.

In the second shift register SR2, a "j"th output terminal Bj may provide an output pulse having a logic level of high. This output pulse is received by a "j"th AND gate in the second gate group GV2 and is ANDed therein with the gate signal GATE2. Then, the output of this "j"th AND gate is supplied to the corresponding row electrode Gj through the gate group GV3.

Figure 5:
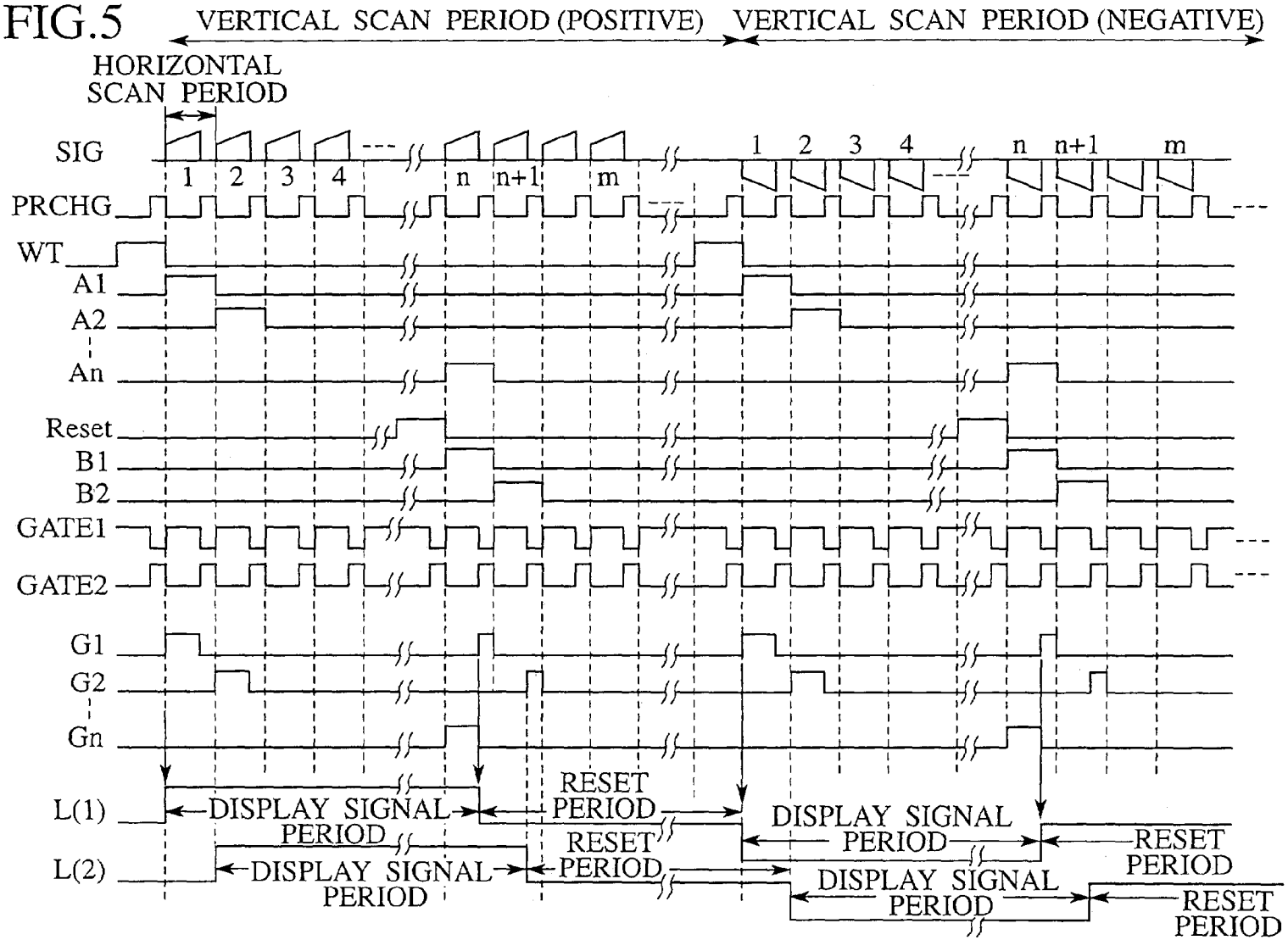
FIG. 5 is a model view showing display and timing signals appearing in successive vertical scan periods according to the embodiment of FIG. 3.

The first shift register SR1 receives a scan start signal WT shown in FIG. 5. In response to the signal WT, the output terminals of the first shift register SR1 sequentially output shifted pulses. When the output terminal Aj of the first shift register SR1 provides the output pulse of high as shown in FIG. 4, the "j"th AND gate of the first gate group GV1 ANDs the output pulse with the gate signal GATE1 and provides the ANDed result to the row electrode Gj through the gate group GV3, to write display signals in the pixels PIX connected to the row electrode Gj.

After n horizontal scan periods from the reception of the scan start signal WT by the first shift register SR1, the second shift register SR2 receives a scan start signal Reset. In response to the signal Reset, the output terminals of the second shift register SR2 sequentially output shifted pulses. When the output terminal Bj of the second shift register SR2 provides the output pulse of high as shown in FIG. 4, the "j"th AND gate of the second gate group GV2 ANDs the output pulse with the gate signal GATE2 and provides the ANDed result to the row electrode Gj through the gate group GV3, to write the reset voltage in the pixels PIX connected to the row electrode Gj. The reset voltage is constant irrespective of the display signals SIG.

In this way, n horizontal scan periods after the output terminal Aj of the first shift register SR1 outputs a pulse to write display signals into the corresponding pixels, the output terminal Bj of the second shift register SR2 outputs a reset pulse to reset the same pixels. Namely, the number "n" is the number of horizontal scan periods to be passed after the writing of display signals and indicates reset timing. According to the embodiment, the number "n" is optionally adjustable.

FIG. 5 is a model view showing display and timing signals appearing in successive vertical scan periods in the active matrix LCD according to the first embodiment. The polarity of a display signal SIG applied to each pixel PIX is inverted frame by frame, i.e., every vertical scan period to prevent liquid crystals in the pixels PIX from burning or deteriorating.

According to the embodiment, each frame (vertical scan period) consists of a display signal period to write and hold a display signal in each pixel and a reset period to write and hold a reset voltage in each pixel.

In FIG. 5, the first shift register SR1 of the row scan-electrode driver 7 of FIG. 3 receives the scan start signal WT at the start of each frame. The signal WT is sequentially shifted so that the output terminals Al to Am of the first shift register SR1 may sequentially output pulses. These pulses are ANDed with the gate signal GATE1 in the first gate group GV1, thereby sequentially providing row select pulses to the row scan-electrodes G1 to Gm as explained with reference to FIG. 4. As a result, the pixels connected to the row scan-electrodes G1 to Gm are selected row by row, and display signals are written into the selected pixels.

In FIG. 5, the second shift register SR2 of the row scan-electrode driver 7 of FIG. 3 receives the scan start signal Reset n horizontal scan periods after the reception of the scan start signal WT by the first shift register SR1. The signal Reset is sequentially shifted so that the output terminals B1 to Bm of the second shift register SR2 may sequentially output pulses. These pulses are ANDed with the gate signal GATE2 in the second gate group GV2, thereby sequentially providing row select pulses to the row scan-electrodes G1 to Gm.

In the reset period defined in each horizontal blanking period of each horizontal scan period, the reset voltage is supplied to all of the column signal-electrodes D1 to Dk. The gate signal GATE2 is timed to select one of the row scan-electrodes G1 to Gm during there set period, and therefore, the reset voltage is written into the pixels connected to the selected row electrode.

As a result, each row of the pixels receives a voltage waveform that alternates between the display signal period and reset period in each frame period (vertical scan period). For example, the first row of the pixels may receive a voltage waveform L(1) shown in FIG. 5, and the second row of the pixels a voltage waveform L(2). The third to "m"th rows of the pixels receive similar voltage waveforms.

In this way, the active matrix LCD according to the above-mentioned embodiment defines, in every frame period (vertical scan period), a display signal period in which a display signal is written and retained in each pixel and a reset period in which a reset voltage is applied to each pixel. The ratio of the display signal period to the reset period is determined by the number "n" of horizontal scan periods interposed between the time when the first shift register SR1 receives the scan start signal WT and the time when the second shift register SR2 receives the scan start signal Reset. The number "n" must be smaller than the number "m" of rows of pixels in the active matrix LCD. The ratio of the display signal period to the reset period, i.e., the number "n" is adjustable in units of horizontal scan period.

Figure 6:
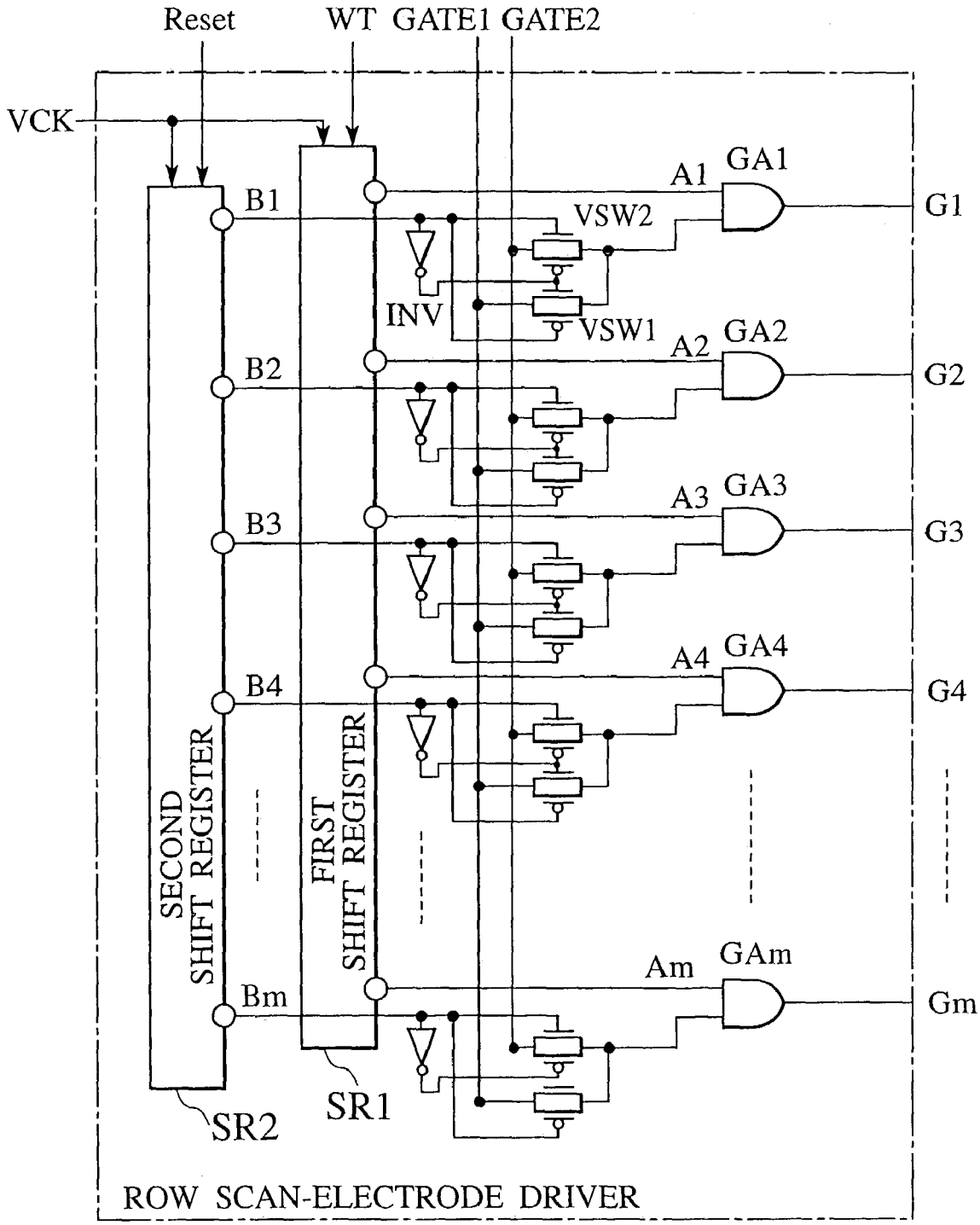
FIG. 6 is a circuit diagram showing a row scan-electrode driver in an active matrix LCD according to another embodiment of the present invention.

FIG. 6 is a circuit diagram showing a row scan-electrode driver in an active matrix LCD according to another embodiment of the present invention. In FIG. 6, the row scan-electrode driver has two shift registers SR1 and SR2, first and second switches VSW1 and VSW2, inverters INV, and AND gates GA1 to GAm. The first and second switches VSW1 and VSW2 forming a pair operate complementarily.

Namely, if one of the switches VSW1 and VSW2 in each pair is ON, the other is OFF. There are m pairs of the first and second switches VSW1 and VSW2 connected to bit-output terminals B1 to Bm of the second shift register SR2, respectively.

Bit-output terminals A1 to Am of the first shift register SR1 are connected to first input terminals of the two-input AND gates GA1 to GAm, respectively. Each of the output terminals B1 to Bm of the second shift register SR2 is connected to control terminals of a corresponding pair of the first and second switches VSW1 and VSW2 through the inverter INV or directly, so that the switches VSW1 and VSW2 may complementarily operate.

When an output bit from the second shift register SR2 is low, only the switch VSW1 is ON to output a gate signal GATE1. When an output bit from the second shift register SR2 is high, only the switch VSW2 is ON to output a gate signal GATE2. The output of the switches VSW1 and VSW2 is connected to a second input terminal of a corresponding one of the two-input AND gates GA1 to GAm. Output terminals of the AND gates GA1 to GAm are connected to row scan-electrodes G1 to Gm, respectively.

Figure 7:
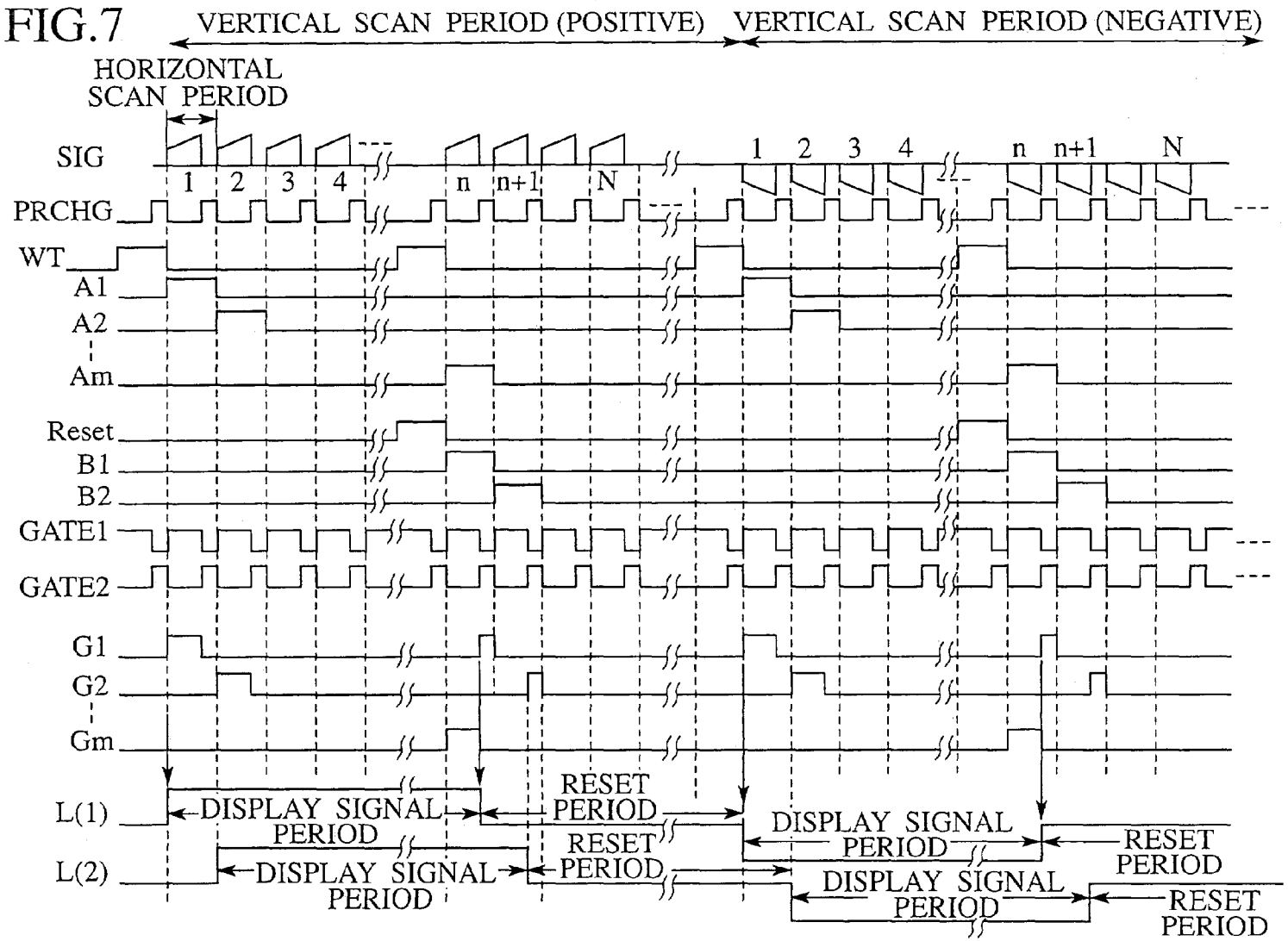
FIG. 7 is a model view showing display and timing signals appearing in successive vertical scan periods according to the embodiment of FIG. 6.

FIG. 7 is a model view showing display and timing signals appearing in successive vertical scan periods according to the embodiment of FIG. 6. The operation of this embodiment is basically the same as that of the embodiment of FIGS. 3 to 5, and therefore, the details thereof will be omitted. According to the embodiment of FIG. 6, a scan start signal WT is first supplied to the first shift register SR1, to sequentially write display signals into pixels row by row. After n horizontal scan periods from the supply of the scan start signal WT to the first shift register SR1, the signal WT is again supplied to the first shift register SR1, and at the same time, a scan start signal Reset is supplied to the second shift register SR2 unlike the embodiment of FIGS. 3 to 5.

The active matrix LCD according to any one of the embodiments of the present invention is characterized in that it can reset each row of pixels at optional timing in each frame period (vertical scan period). A circuit configuration to realize this characteristic is not limited to those mentioned above.

FIGS. 8A and 8B are model views showing an example of a voltage applied to pixels and a liquid crystal response in an active matrix LCD according to an embodiment of the present invention. In FIG. 8A, the polarity of a display signal applied to each pixel is inverted frame by frame or vertical scan period by vertical scan period, to prevent liquid crystals from burning or deteriorating. Namely, the polarity of voltage applied to each pixel is inverted write period by write period.

The active matrix LCD according to the embodiment defines, in each frame period, a display signal period to write and hold display signals in pixels and a reset period to write and hold a reset voltage in the pixels. In FIG. 8A, voltage (alternating current) applied to each pixel includes a reset level for the reset period. The reset level is at the center of the applied voltages and is substantially zero. With respect to the applied voltage of FIG. 8A, liquid crystals in each pixel provide a response curve of FIG. 8B. The response curve indicates that each pixel alternately displays an image and black frame by frame (vertical scan period by vertical scan period). This provides the following effects:

(1) Inserting a black period in every frame improves dynamic iamge resolution by minimizing afterimages that are resolution deteriorating factors in a hold-type LCD. Even with liquid crystals of slow response that may incompletely be reset to black during the reset period, the embodiment can attenuate the brightness of liquid crystals during the reset period, to minimize afterimages and improve dynamic image resolution.

(2) Inserting a reset period after a display signal period in each frame lowers a voltage applied to each pixel below a threshold level during the reset period and improves response when displaying halftones. Accordingly, dynamic image resolution can be improved.

(3) The ratio of the display signal period to the reset period shown in FIG. 8A is adjustable by changing the timing of the control signals WT and Reset supplied to the row scan-electrode driver 7.

The reset period or the black displaying period inserted in each frame according to any one of the embodiments of the present invention may decrease optical output during the reset period and accordingly average brightness during each frame becomes low. The active matrix LCD according to any one of the embodiments of the present invention, however, can optionally set the ratio of the display signal period to the reset period, to optionally balance brightness and dynamic image response according to system requirements. The present invention can provide an active matrix LCD having different display modes such as a "brightness priority" mode and a "dynamic image characteristic priority" mode.

FIGS. 9A and 9B are model views showing another example of a voltage applied to pixels and a liquid crystal response in an active matrix LCD according to an embodiment of the present invention. This embodiment provides positive and negative frames with different display and reset periods. The positive frame is a frame in which a display signal of positive polarity is applied to each pixel, and the negative frame is a frame in which a display signal of negative polarity is applied to each pixel. To prevent liquid crystals of an LCD from burning or deteriorating, direct-current components contained in voltage applied to liquid crystals must be minimized.

The active matrix LCD of the embodiment is capable of optionally set a reset period in each frame (vertical scan period). The reset period may be changed frame by frame. In FIG. 9A, positive voltage applied to a pixel has an amplitude Vp and negative voltage applied to the pixel has an amplitude Vm that is different from the positive amplitude Vp. For such frames involving asymmetrical positive and negative voltage levels, the embodiment can set different reset periods according to the following condition:

$$Vp \times tp \approx Vm \times tm$$

where "tp" is a display signal period for writing and holding the positive voltage Vp and "tm" is a display signal period for writing and holding the negative voltage Vm.

In this way, the embodiment can adjust an average of direct current components in pixel voltage along a time axis. FIG. 9B shows liquid crystal response corresponding to the voltage of FIG. 9A. If the active matrix LCD has 1000 rows of pixels to display in one frame, direct current components remaining after adjusting voltage are finely adjustable according to the embodiment at the accuracy of 1/1000 along a time axis. Through the fine adjustment, the embodiment can even zero the direct current components.

As explained above, the active matrix LCD according to any one of the embodiments of the present invention writes and retains display signals in pixels and writes a reset voltage in the pixels in each frame period. Namely, the present invention inserts a black period in each frame to minimize afterimages that are resolution deteriorating factors in a hold-type LCD, thereby improving dynamic image resolution. The embodiment inserts a reset period during which a voltage below a threshold level is applied to each pixel after a display signal period in each frame, thereby improving response when displaying halftones.

The active matrix LCD according to any one of the embodiments of the present invention optionally sets the ratio of a display signal period to a reset period in each frame, to balance the brightness and dynamic image response of the LCD according to system requirements. The active matrix LCD according to any one of the embodiments of the present invention can have different display modes such as a "brightness priority" mode and a "dynamic image characteristic priority" mode.

It should be understood that many modifications and adaptations of the invention will become apparent to those skilled in the art and it is intended to encompass such obvious modifications and changes in the scope of the claims appended hereto.

What is claimed is:

1. An active matrix LCD having column electrodes for display signals;

row electrodes for scanning, the row electrodes being orthogonal to the column electrodes;

pixels arranged in a matrix at intersections of the column and row electrodes;

a column driver to sequentially supply to the column electrodes display signals in a display signal period of each horizontal scan period and a reset voltage in part or in whole, of a horizontal blanking period of each horizontal scan period; and a row driver to sequentially supply row select pulses to the row electrodes, wherein the row driver comprises:

a first shift register to sequentially generate first row select pulses in response to a first scan start signal;

a first gate circuit to supply the first row select pulses to the row electrodes so that the display signals in respective display signal periods are written in respective rows of the pixels;

a second shift register to sequentially generate second row select pulses in response to a second scan start signal; and a second gate circuit to supply the second row select pulses to the row electrodes so that the reset voltage in respective horizontal blanking periods are written in the respective rows of the pixels wherein the first row select pulses and the second row select pulses are supplied to the row electrodes at different timings.

2. The active matrix LCD of claim 1, wherein the column driver comprises:

a level setter configured to partly or wholly set the horizontal blanking period of the horizontal scan period as a period to provide the reset voltage; and an output unit configured to turn on all switches of the column driver in a reset period during which display signals have no image information, and in cooperation with the level setter, supply the reset voltage to all of the column electrodes; and the row driver is:

configured to sequentially provide the first and second row select pulses to select the row electrodes one after another for each horizontal scan period including the display signal period during which the column driver provides the column electrodes with the display signals having image information and part or whole of the horizontal blanking period during which the output unit provides the column electrodes with the reset voltage such that an absolute value of voltage accumulated in each pixel due to the display signal is below a predetermined value in each vertical scan period.

3. The active matrix LCD of claim 1, wherein each of the second row select pulses is supplied to each of the row electrodes after a predetermined plurality of horizontal scan periods after each of the first row select pulses is supplied to each of the row electrodes so that the pixels in each row are reset after the predetermined plurality of horizontal scan periods after the display signals are written in the pixels in each row.

* * * * *